US007641464B2

(12) United States Patent
Griffin et al.

(10) Patent No.: US 7,641,464 B2
(45) Date of Patent: Jan. 5, 2010

(54) SYSTEM AND METHOD FOR CENTERING A CLAY PLUG ON A POTTER'S WHEEL

(76) Inventors: David Griffin, 13 Kickapoo Pl., Charleston, IL (US) 61920; Dwain Naragon, P.O. Box 1134, Charleston, IL (US) 61920

( * ) Notice: Subject to any disclaimer, the term of this patent is extended or adjusted under 35 U.S.C. 154(b) by 0 days.

(21) Appl. No.: 11/805,323

(22) Filed: May 23, 2007

(65) Prior Publication Data

US 2008/0290540 A1 Nov. 27, 2008

(51) Int. Cl.
*B28B 1/02* (2006.01)

(52) U.S. Cl. ..... 425/267; 425/263; 425/264; 425/266; 425/459; 425/DIG. 120

(58) Field of Classification Search ..... 425/262–268, 425/459–460, DIG. 120
See application file for complete search history.

(56) References Cited

U.S. PATENT DOCUMENTS

| | | | | | |
|---|---|---|---|---|---|
| 1,377,785 | A | * | 5/1921 | Odelberg | 425/459 |
| 1,505,860 | A | * | 8/1924 | Byford | 264/294 |
| 1,637,708 | A | * | 8/1927 | Porter | 425/417 |
| 2,642,644 | A | * | 6/1953 | Robinson | 425/447 |
| 3,520,036 | A | * | 7/1970 | Maloney | 425/90 |
| 3,844,072 | A | * | 10/1974 | Haigh et al. | 451/510 |
| 3,849,054 | A | * | 11/1974 | Jordache | 425/459 |
| 3,894,830 | A | * | 7/1975 | Edwards | 425/459 |
| 3,994,659 | A | * | 11/1976 | Takahashi | 425/425 |
| 4,028,041 | A | * | 6/1977 | Zambrano, Jr. | 425/459 |
| 4,057,384 | A | | 11/1977 | Reid | |
| 4,102,622 | A | * | 7/1978 | Simpson | 425/268 |
| 4,125,349 | A | * | 11/1978 | Johnsen | 425/192 R |
| 4,222,577 | A | * | 9/1980 | Giffin | 279/114 |
| 4,332,542 | A | * | 6/1982 | Matsui | 425/459 |
| 4,585,240 | A | | 4/1986 | Giffin | |
| 4,689,001 | A | | 8/1987 | Yoder | |
| 4,702,920 | A | * | 10/1987 | Goodman | 425/459 |
| 5,180,174 | A | * | 1/1993 | Province | 279/6 |
| 5,244,376 | A | * | 9/1993 | Meyers | 425/425 |
| 5,711,196 | A | * | 1/1998 | Reid et al. | 82/1.11 |
| 5,916,344 | A | * | 6/1999 | Cucchi | 82/127 |
| 7,105,338 | B1 | * | 9/2006 | Holmes et al. | 435/286.3 |
| 7,114,933 | B2 | * | 10/2006 | Adachi et al. | 425/3 |
| 7,261,543 | B2 | * | 8/2007 | Lester | 425/182 |
| 2004/0033284 | A1 | * | 2/2004 | Adachi et al. | 425/135 |
| 2006/0016060 | A1 | * | 1/2006 | Lester | 29/428 |
| 2007/0200278 | A1 | * | 8/2007 | Lester | 264/310 |
| 2008/0210647 | A1 | * | 9/2008 | Hornak et al. | 211/13.1 |

FOREIGN PATENT DOCUMENTS

| | | | | |
|---|---|---|---|---|
| JP | 2063802 | A | | 3/1990 |
| JP | 9141622 | A | | 6/1997 |
| JP | 11042621 | A | * | 2/1999 |
| JP | 2002067017 | A | | 3/2002 |
| JP | 2004209978 | A | | 7/2004 |
| JP | 2006205701 | A | | 8/2006 |

* cited by examiner

*Primary Examiner*—Eric Hug
*Assistant Examiner*—Seyed Masoud Malekzadeh

(57) ABSTRACT

A system and method for centering a clay plug on a potter's wheel before rotation of the potter's wheel includes a rotatable adapter having a central axis aligned with the central axis of the potter's wheel, a rotatable toroidal disk bat whose central axis is aligned with central axis of the rotatable adapter, and a clay plug having a central axis aligned with the central axis of the rotatable toroidal disk bat.

4 Claims, 4 Drawing Sheets

SYSTEM AND METHOD FOR CENTERING A CLAY PLUG ON A POTTER'S WHEEL

FIELD

The present invention pertains to a system and method usable with a potter's wheel; more particularly the present invention pertains, to a system and method for centering a clay plug on a potter's wheel before the clay plug is rotated by the potter's wheel for shaping into a vessel.

STATEMENT REGARDING FEDERALLY-FUNDED RESEARCH AND DEVELOPMENT

The invention described in this patent application was not the subject of federally sponsored research or development.

BACKGROUND

The first use of a potter's wheel is unknown; however, some scholars date the use of a potter's wheel to shape moist clay into vessels as early as 6000 BC. Egyptian mythology suggests that the god Chnum formed the first human beings on a potter's wheel. Fragments of pottery made on a potter's wheel have been found in Iraq and dated to as early as 3000 BC. Some say that the verse in the Old Testament book of Isaiah which reads:

> "Yet, O LORD, Thou art our Father; we are the clay, and Thou art our Potter; and we all are the work of Thy hand, . . . "

refers to the use of a potter's wheel.

Prior art potter's wheels are well known by many who have pursued making ceramic objects as a hobby. Specifically, to make a vessel using a potter's wheel, a moist ball of clay or a clay plug is placed on a flat surface called a bat or batterboard. The clay plug is then rotated by the potter's wheel. During the rotation process, the unformed clay plug is centered by the artisan with respect to the rotation of the potter's wheel by applying pressure with one hand on one side of the rotating clay plug and applying pressure with the other hand on top of the rotating clay plug. Alternatively, the unformed clay plug may be pulled up and down until the artisan perceives, by the use of tactile input through the finger tips, that the axis of rotation of the unformed clay plug is aligned with the axis about which the potter's wheel turns.

Despite the thousands of years during which prior art potter's wheels have been used, the manual centering of the unformed rotating clay plug with respect to the rotation of the potter's wheel remains the biggest challenge for beginning and intermediate level potters. Those new to the creation of vessels from a rotating plug of moist clay must continually practice the craft of shaping the clay plug on a turning potter's wheel to develop the proper feel with their thumbs, fingers, and hands to assure proper centering of the unformed rotating clay plug before a quality vessel can be properly shaped.

In recent years, accessories for use with prior art potter's wheels, as described below, have been developed, but none of these accessories directly addresses the difficulty of properly centering the unformed clay plug on a rotating potter's wheel.

U.S. Pat. No. 4,585,240 describes a holding device which is attached to a potter's wheel for trimming the foot of a vessel after the clay plug has been centered and formed by the artisan into a vessel.

U.S. Pat. No. 4,057,384 describes a mechanical device called the Axner Power Arm which attaches to the potter's wheel to provide additional leverage for an artisan when shaping the clay plug.

U.S. Pat. No. 4,689,001 describes a flat interchangeable bat sold by the American Art Clay Co., Inc.

Accordingly, there still remains a need in the art for a system and method which will properly center an unformed plug of moist clay with respect to a potter's wheel without the need to first rotate the clay plug to manually center the clay plug with respect to the potter's wheel before the clay plug is formed into a vessel.

SUMMARY

According to the present invention there is provided a system and method for the proper centering an unformed plug of moist clay with respect to the axis of rotation of a rotating potter's wheel without having to rotate the moist clay plug and rely on the touch of the artisan's hands to assure proper centering of the moist clay plug before forming the clay plug into a vessel.

The system and method of the present invention includes a rotatable adapter having a central well formed therein. The rotatable adapter is mechanically connected to the rotating portion of the potter's wheel so that the central axis of rotation of the rotatable adapter is aligned with the axis of rotation of the potter's wheel.

Placed on top of the rotatable adapter is a toroidal disk bat. The toroidal disk bat includes a central tubular section which provides a well into which the moist clay plug is inserted. The central axis of rotation of the toroidal disk bat is aligned with the axis of rotation of the rotatable adapter. The bottom of the moist clay plug contacts a removable plate which forms the bottom of the well into which the moist clay plug is inserted within the central tubular portion of the toroidal disk bat. The removable plate is slidably positioned against a ledge formed within lower portion of the central tubular section of the toroidal disk bat.

The toroidal disk bat is mechanically connected to the rotatable adapter so that the toroidal disk bat turns together with the rotatable adapter as a single unit.

Use of the system and method of the present invention is initiated by first filling an extruder/plunger with moist clay. The bottom of the extruder/plunger is sized to mechanically engage and be positioned by a shoulder formed in the top portion of the central tubular portion of the toroidal disk bat. Once the extruder/plunger is mechanically engaged and positioned the toroidal disk bat, the bottom of the moist clay plug within the extruder/plunger is pushed out of the extruder/plunger and into the well provided in the central tubular section of the toroidal disk bat. The bottom of the moist clay plug exiting the extruder plunger does not pass all the way through the central tubular section of the toroidal disk bat as it is contained therein by the removable plate which rests on the ledge formed in the lower portion of the central tubular portion of the toroidal disk bat. The remainder of the moist clay plug is pushed out of the extruder plunger to form a substantially cylindrical moist clay plug extending upwardly from the toroidal disk bat. Because the well for the moist clay plug provided by the central tubular section of the toroidal disk bat is centered with respect to rotatable adapter, which in turn is centered with respect to the rotating portion of the potter's wheel, the axis of rotation of the substantially cylindrical moist clay plug is then aligned with the axis of rotation of the rotatable toroidal disk bat. Thus, the unformed moist clay plug is centered with respect to the potter's wheel before the potter's wheel is ever caused to rotate.

BRIEF DESCRIPTION OF THE DRAWING FIGURES

A still better understanding of the system and method of the present invention for centering a clay plug on a potter's wheel may be had by reference to the drawing figures wherein.

DESCRIPTION OF THE EMBODIMENTS

Figure 1A:
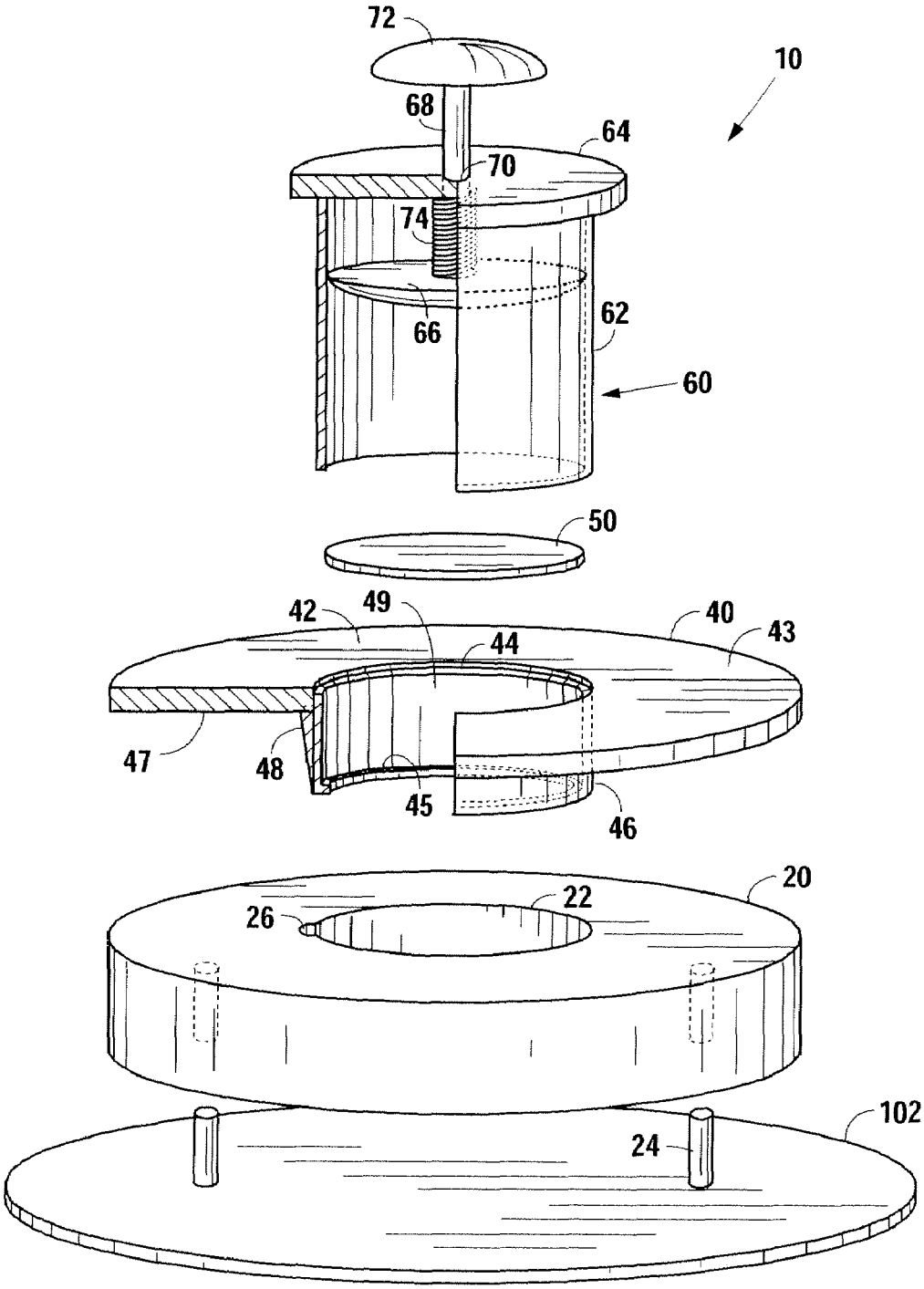
FIG. 1A is a front perspective view, in partial section, of the system of the present invention.

A better understanding of the construction of the system of the present invention 10 for centering an unformed moist clay plug on a potter's wheel may be had by reference to FIG. 1A. Therein it may be seen that the present system 10 is constructed for use on a potter's wheel assembly 100 (FIG. 2A) before the potter's wheel assembly is caused to rotate. Mechanically connected to the rotating portion 102 of the potter's wheel assembly 100 is a rotatable adapter 20. The rotatable adapter 20 has a hole 22 formed in the center portion thereof. The rotatable adapter 20 turns together with the rotating portion 102 of the potter's wheel assembly 100 about the axis of rotation of the potter's wheel because of the pins 24 used to mechanically connect the rotatable adapter 20 to the rotating portion 102 of the potter's wheel assembly 100.

Placed over the rotatable adapter 20 is a rotatable toroidal disk bat 40 according to the present invention. The rotatable toroidal disk bat 40 includes a substantially circular plate 42. In the midst of the substantially circular plate 42 is a central tubular portion 44. In the preferred embodiment, on the outside 46 of the central tubular portion 44 is at least one key 48. The key 48 is shaped and positioned to engage at least one key receiver 26 in the rotatable adapter 20. Thus, when the key 48 and the key receiver 26 in the rotatable adapter 20 are fitted together, one with the other, the toroidal disk bat 40 and the rotatable adapter 20 will rotate together around the axis of rotation of the rotatable adapter 20 as one piece. Mechanical connections between the toroidal disk bat 40 and the rotatable adapter 20 other than a key 48 and a key receiver 26 to cause the toroidal disk bat 40 and the rotatable adapter 20 to turn as a single unit may be used without departing from the scope of the present invention. For example, pins such as discussed above for mechanical connection of the rotatable adapter 20 to the potter's wheel assembly may be used.

As may be seen by reference to FIG. 1A, the rotatable toroidal disk bat 40 has a planar top surface 43 and a planar bottom surface 47. The central tubular portion 44 forms a substantially circular well 49 which extends downwardly from the planar top surface 43. The substantially central well 49 enables containment of the unformed moist clay plug 108 shown in FIG. 4C. The external dimension of the central tubular portion 44 enables its interfitment within the hole 22 in the rotatable adapter 20. The top portion of the central tubular portion 44 includes a shoulder 54 on its inner surface. The shoulder 54 engages and aligns the bottom of the cylinder portion 62 of the extruder/plunger 60. The bottom of the central tubular portion 44 includes a ledge 45 on its inner surface on which the false bottom 50 rests. The false bottom 50 forms the bottom of the substantially circular well 49 which provides support for the bottom of the moist clay plug 108.

Shown also in FIG. 1A is a substantially circular plate or false bottom 50 which is sized for slidable frictional interfitment within the central tubular portion 44 of the toroidal disk bat 40 and against a ledge 45 formed within the central tubular portion 44 of the bat 40. As previously indicated the false bottom 50 forms the bottom of the well 49 which contains the moist clay plug 108 in the central tubular portion 44 of the toroidal disk bat 40.

Positioned above the false bottom 50, shown in FIG. 1A, is an extruder/plunger assembly 60. The extruder/plunger 60 includes a hollow cylinder 62 having a top 64 on its upper end. Within the cylinder 62 is a disk 66 sized to fit within the hollow cylinder portion 62 of the extruder/plunger 60. Connected to the disk 66 is a shaft 68 which passes through a hole 70 in the top 64. On top of the shaft 68 is a handpiece 72. Surrounding the shaft 68 between the top 64 and the disk is a coil spring 74.

Figure 1B:
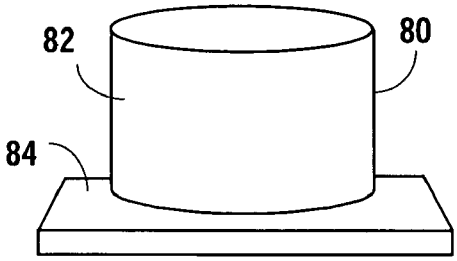
FIG. 1B is a front perspective view of the ejector.

Shown in FIG. 1B is an ejector 80 for removal of the bottom of the moist clay plug 108 from the well 49 provided within the central tubular portion 44 of the toroidal disk bat 40. The plug ejector 80 is used for applying a substantially upward force on the bottom of the moist clay plug 108 to move the moist clay plug 108 out of the well 49 provided within the central tubular portion 44 of the toroidal disk bat 40 as will be explained below. The plug ejector 80 includes a cylinder 82 sized to fit within the central tubular portion 44 of the bat 40. For stability, the cylinder 82 is located on a flat plate 84 whose footprint is larger than the cylinder 82.

A still better understanding of the system and method of the present invention 10 may be had by a review of its operation.

Figure 2A:
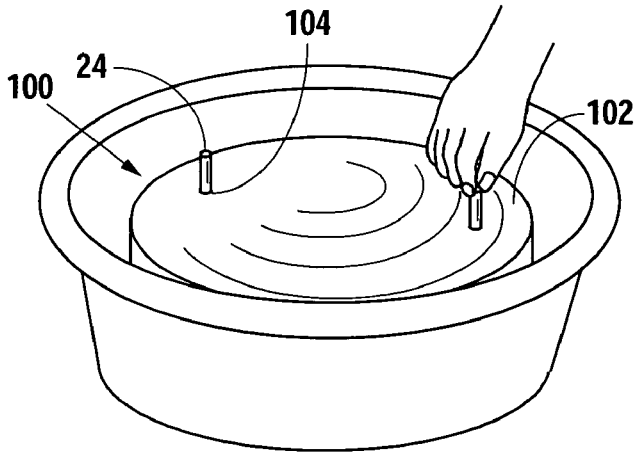
FIG. 2A is a perspective view of a potter's wheel.

As shown in FIG. 2A, the system and method of the present invention 10 for centering a clay plug on a potter's wheel is used with a potter's wheel assembly 100. Potter's wheel assemblies 100 typically include a variety of different parts but all potter's wheels generally include a substantially flat rotating surface 102 which is turned by a motor or some other source of rotational power about a first substantially vertical axis. In the embodiment shown in FIG. 2A the manufacturer of the potter's wheel assembly 100 has provided holes 104 in the rotating surface 102 into which at least one locating pins 24 is placed.

Figure 2B:
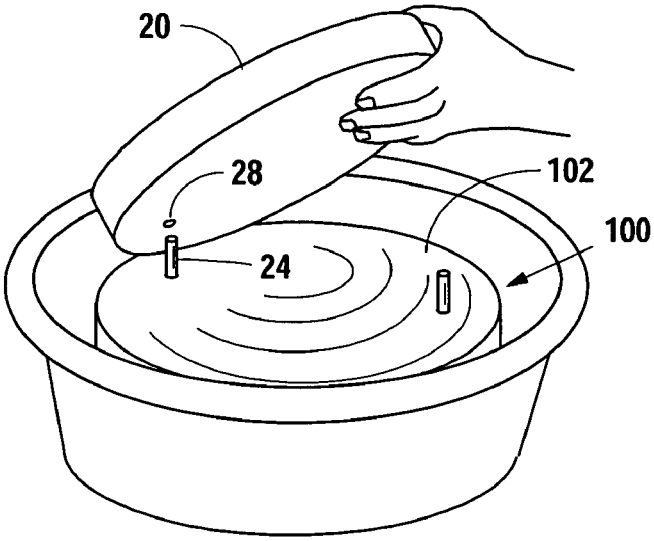
FIG. 2B is a perspective view of the rotatable adapter being placed on the potter's wheel.

As shown in FIG. 2B, a rotatable adapter 20 is placed on the rotating portion 102 of the potter's wheel assembly 100. The pins 24 placed in the rotating portion 102 of the potter's wheel 100 in the previous step are aligned with holes 28 formed in the bottom of the rotatable adapter 20. When in place the rotatable adapter 20 rotates as one with the rotating portion 102 of the potter's wheel 100.

Figure 2C:
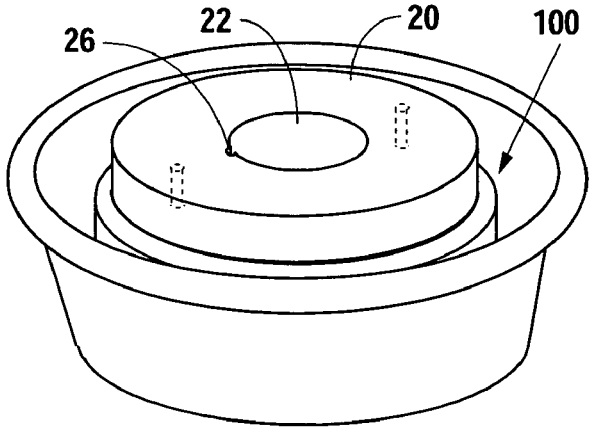
FIG. 2C is a perspective view of the rotatable adapter positioned on the potter's wheel.

As shown in FIG. 2C, the rotatable adapter 20 includes a central hole 22 whose purpose will become apparent below. In FIG. 1A and in FIG. 2C, the rotatable adapter 20 is shown with a key receiver 26.

Figure 3A:
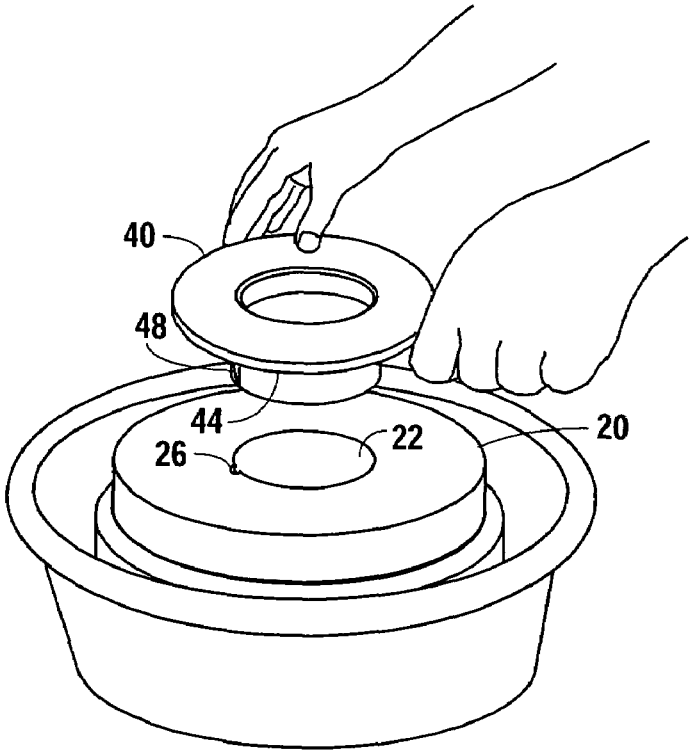
FIG. 3A is a perspective view of a toroidal disk bat according to the instant invention being placed on the rotatable adapter.
Figure 3B:
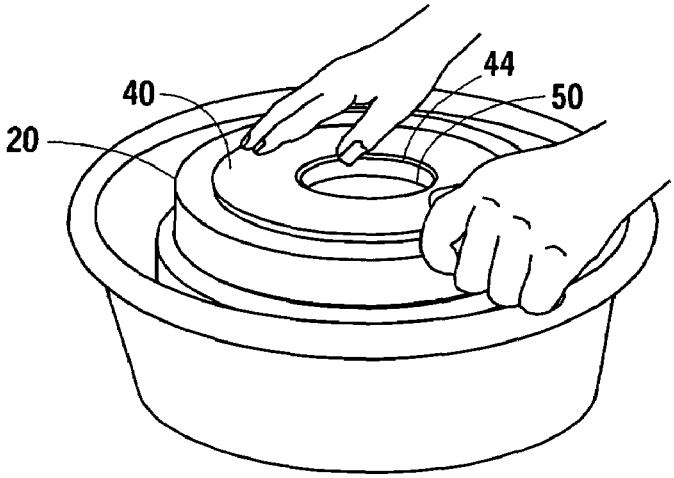
FIG. 3B is a perspective view of the toroidal disk bat according to the present invention ready to receive the moist clay plug from the extruder/plunger.

Shown in FIG. 3A and in FIG. 3B is the placement of the toroidal disk bat 40 on the rotatable adapter 20. Typically, an artisan is supplied with multiple bats of different sizes, enabling the use of different quantities of moist clay; however, all toroidal disk bats 40 are made to rotate about a second substantially vertical axis. The central tubular portion 44 of the toroidal disk bat 40 fits within the hole 22 formed in the center of the rotatable adapter 20 joined key 48 which fits snugly within key receiver 26. Those of ordinary skill in the art will understand that pins or slot connections may be used in place of the key 48 and key receiver 26 connection without affecting the operability of the disclosed invention. When the toroidal disk bat 40 and the rotatable adapter 20 are put together, the second substantially vertical axis of the toroidal disk bat 40 will be aligned within first substantially vertical axis of the potter's wheel assembly 100.

Located within the lower portion of the central tubular portion 44 of the toroidal disk bat 40 is the removable substantially flat false bottom or plate 50 which is large enough to slidably engage the interior walls of the central tubular portion 44 of the bat 40 but small enough to be able to slide therethrough. The position of the false bottom 50 within the central tubular portion 44 is preferably determined by contact of the false bottom with a ridge 45 formed within the lower portion central tubular portion 44.

Figure 4A:
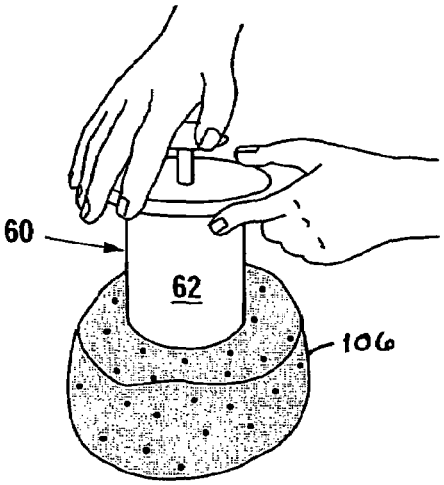
FIG. 4A is a perspective view of the extruder/plunger being placed over a block of moist clay.
Figure 4B:
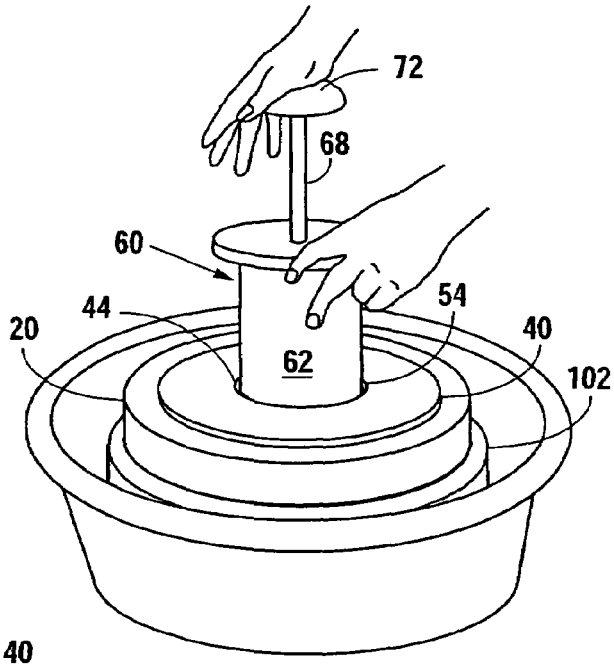
FIG. 4B is a perspective view of the extruder/plunger with moist clay plug contained therein positioned on the top portion of the central tubular portion of the toroidal disk bat.

The next step in the use of the system and method of the present invention for centering a moist clay plug on a potter's wheel is shown in FIG. 4A. Specifically, the moist clay plug must be placed in the well 49 provided in the central tubular portion 44 of the toroidal disk bat 40. This is accomplished by using the extruder/plunger 60 shown in FIG. 1A. Specifically, as shown in FIG. 4A the cylinder portion 62 of the extruder/plunger 60 is pushed downwardly over a block of moist clay 106. Such action causes a moist clay plug 108 to be formed within the cylinder portion 62. The moist clay plug 108 occupies the space within the hollow cylindrical portion 62 of the extruder/plunger 60. With the moist clay plug 108 within the cylinder 62, the extruder/plunger 60 is moved to a position over the toroidal disk bat 40 as shown in FIG. 4B.

Figure 4C:
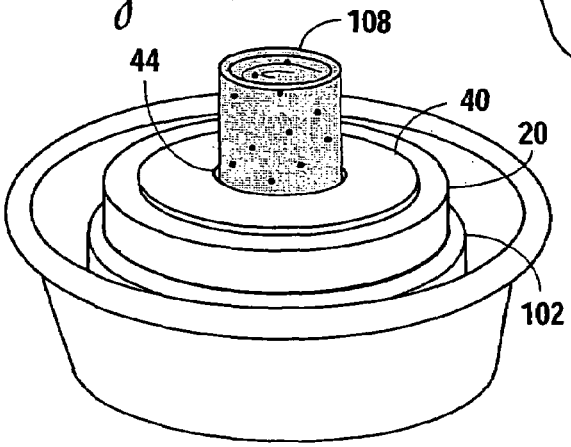
FIG. 4C is a perspective view of the moist clay plug on the toroidal disk bat after being pushed from the extruder/plunger.

As shown in FIG. 1A, the cylinder 62 is sized to mate with a shoulder 54 formed in the top portion of the central tubular portion 44 of the toroidal disk bat 40. If desired, a locking flange ring (not shown) may be used in place of the shoulder 54. With the bottom of the cylinder 62 seated within the shoulder 54, the handpiece 72 on the top of the shaft portion 68 of the extruder/plunger 60 is depressed. This movement causes the disk 66 on the bottom of the shaft 68 to contact the top of the moist clay plug 108 which in turn causes the bottom portion of the moist plug of moist clay 108 to move out of the cylinder 62 into the well 49 provided in the central tubular portion 44 of the toroidal disk bat 40 so that the axis of rotation of the moist clay plug 108 will be aligned with axis of rotation of the toroidal disk bat 40. The remaining portion of the moist clay plug 108 remains above the toroidal disk bat 40 as shown in FIG. 4C. With the completion of the ejection of the bottom of the moist clay plug 108 into the well 49 provided in the central tubular portion 44 of the bat 40 and the removal of the extruder/plunger 60 from over the clay plug 108, the artisan is now ready to cause the rotating portion 102 of the potter's wheel assembly 100 to turn the moist clay plug 108 about an axis which is co-axial with the axis of rotation of the rotating portion 102 of the potter's wheel assembly 100.

Those of ordinary skill in the art will understand that because the central axis about which the rotatable adapter 20 is made to be aligned with the central axis of the potter's wheel assembly 100, the rotatable adapter 20 is centered with respect to the potter's wheel assembly 100. Then, because the central axis about which the toroidal disk bat 40 is made is aligned with the central axis of the rotatable adapter 20, the toroidal disk bat 40 is centered with respect to the rotatable adapter 20. More particularly, the well 49 containing the moist clay plug 108 within the central tubular portion 44 of the toroidal disk bat 40 is centered with respect to the tubular adapter 20. Finally, because the bottom of the clay plug 108 is caused to be positioned within the well 49 provided in the central tubular portion 44 of the toroidal disk bat 40 and the central axis of the clay plug 108 is aligned with the central axis of the toroidal disk bat 40 the clay plug 108 is centered with respect to the potter's wheel assembly 100 before the rotatable portion 102 of the potter's wheel assembly 100 ever begins to turn.

Figure 5A:
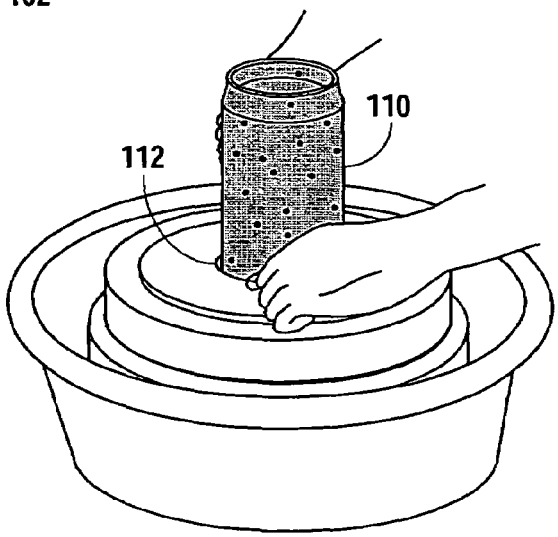
FIG. 5A is a perspective view of the vessel formed from the moist clay plug being removed from the toroidal disk bat by the use of a wire cut-off.

Once the artisan has shaped the unformed clay plug 108 into the desired shape it is now necessary to remove the completed shaped vessel from the toroidal disk bat 40 for additional work at a later time such as applying a glaze or for firing in a kiln. Such removal is typically done by using a wire 112 to sever the shaped vessel 110 from that portion 114 of the clay plug 108 which remains within the well 49 within the central tubular portion 44 of the toroidal disk bat 40 as shown in FIG. 5A.

Figure 5B:
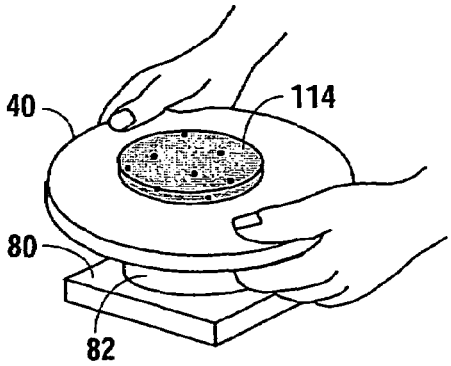
FIG. 5B is perspective view of the removal of the plate and the remainder of the moist clay plug from within the central tubular portion of the toroidal disk bat.

As shown in FIG. 5B the bottom portion 114 of the clay plug 108 must now be removed from the well 49 provided within the central tubular portion 44 of the toroidal disk bat 40. This is accomplished by placing the toroidal disk bat 40 over the ejector 80. Because the cylinder portion 82 of the ejector 80 is sized to fit within the central tubular portion 44 of the toroidal disk bat 40, the cylinder portion 82 of the ejector 80 will cause the remaining clay 114 in the well 49 provided within the central tubular 44 portion of the toroidal disk bat 40 to move up and out of the well 49 provided within the toroidal disk bat 40. The toroidal disk bat 40 may now be cleaned and made ready for use with another clay plug 108. The unused section of the clay plug 114 may be recycled and mixed with a compatible block of moist clay.

While the system and method of the present invention has been described according to its preferred and alternate embodiments, those of ordinary skill in the art will understand that numerous other embodiments of the present invention have been enabled. Such numerous other embodiments shall be included within the scope and meaning of the appended claims.

What is claimed is:

1. An assembly on which an unformed moist clay plug is spun for shaping by an artisan, said assembly comprising:

a source of rotational power;

a rotatable base mechanically connected to said source of rotational power for rotation about a first substantially vertical axis;

a rotatable adapter having a central hole formed therein mechanically connected to said rotatable base;

a toroidal disk bat having a planar top surface and a planar bottom surface and a central tubular portion providing a substantially circular central well extending from said planar bottom surface for containing the unformed moist clay plug formed about a second substantially vertical axis, said central tubular portion constructed and arranged for interfitment within said central hole in said rotatable adapter;

a substantially circular removable plate constructed and arranged for a slidable engagement fit against a ledge formed within said substantially circular central well portion of said central tubular portion of said toroidal disk bat;

said substantially circular removable plate providing vertical support for said unformed moist clay plug within said substantially circular central well in said central tubular portion of said toroidal disk bat;

a mechanical connection between an external dimension of said central tubular portion of said toroidal disk bat and said rotatable adapter which causes said second substantially vertical axis of said substantially circular central well in said central tubular portion of said toroidal disk bat to be co-axial with said first substantially vertical axis in said rotatable base;

whereby when an unformed moist clay plug is placed within said substantially circular central well provided in said central tubular portion of said toroidal disk bat and said toroidal disk bat is mechanically connected to said rotatable adapter, the unformed moist clay plug will be centered and with respect to rotation about said first substantially vertical axis before the unformed moist clay plug is rotated.

2. The assembly as defined in claim 1 wherein said substantially circular removable plate is sized to pass through said substantially circular central well and contact a ridge formed within the lower portion of said substantially circular central well of said central tubular portion of said toroidal disk bat.

3. The assembly as defined in claim 1 wherein said mechanical connection between said rotatable adapter and said toroidal disk bat includes at least one key formed on an external dimension of said substantially circular well and at least one key receiver formed in said central hole of said rotatable adapter.

4. The assembly as defined in claim 1 further including an extruder/plunger engageable with a top portion of said substantially circular central well provided within said central tubular portion for placing the unformed moist clay plug within said toroidal disk bat.

* * * * *